United States Patent [19]

Bennett

[11] 4,412,634

[45] Nov. 1, 1983

[54] CAP AND NECK UNIT FOR FLUID DISPENSER

[76] Inventor: Robert A. Bennett, 170 Sturbridge Rd., Easton, Conn. 06425

[21] Appl. No.: 319,947

[22] Filed: Nov. 10, 1981

[51] Int. Cl.[3] ..... B65D 41/04; B65D 47/20

[52] U.S. Cl. ..... 222/519; 222/536; 222/553

[58] Field of Search ..... 222/519, 520, 536, 549, 222/553

[56] References Cited

U.S. PATENT DOCUMENTS

| | | | |
|---|---|---|---|
| 297,952 | 4/1884 | Rubin | 222/519 X |
| 920,273 | 5/1909 | Coons | 222/519 |
| 2,165,825 | 7/1939 | Bultzingslowen | 222/519 |
| 2,533,915 | 12/1950 | Brooks | 222/520 X |
| 3,471,066 | 10/1969 | Michallef | 222/519 |

FOREIGN PATENT DOCUMENTS

| | | | |
|---|---|---|---|
| 31184 | 4/1885 | Fed. Rep. of Germany | 222/519 |
| 121313 | 2/1977 | Norway | 222/519 |

*Primary Examiner*—David A. Scherbel

[57] ABSTRACT

A cap and neck unit having a vertical neck with interconnected upper and lower sections. The lower section defines a first hollow vertical cylinder having a closed top end with a central circular opening. The upper section defines a second hollow vertical cylinder open at its upper and lower ends. The lower end is coincident with the central opening. The outer surface of said first cylinder has a single continuous endless groove which has upper and lower horizontal regions interconnected by inclined regions. A cap has a top and a vertical interior chamber extending downwardly from the top and terminating in a hollow cylindrical region open at bottom and disposed concentrically about the neck. The region has an iwnardly extending horizontal prong engaging said groove. The cap is rotatable between a first position at which the prong engages the lower horizontal region and a second position at which the prong engages the upper horizontal region. A sealing device is secured to the top to close the upper end when the cap is in the first position and leave the upper end open when the cap is in its second position.

3 Claims, 6 Drawing Figures

FIG. 1
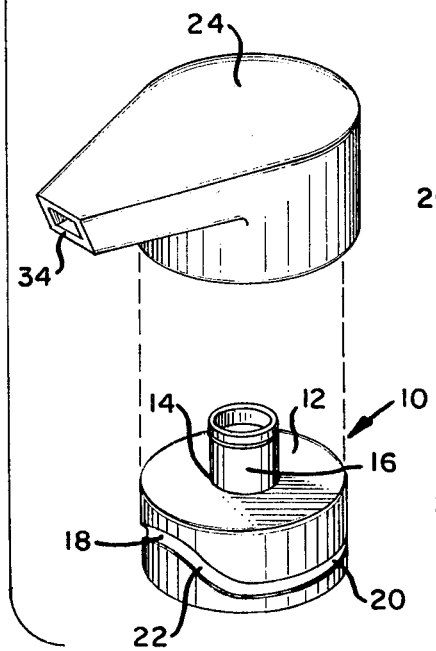
FIG. 2
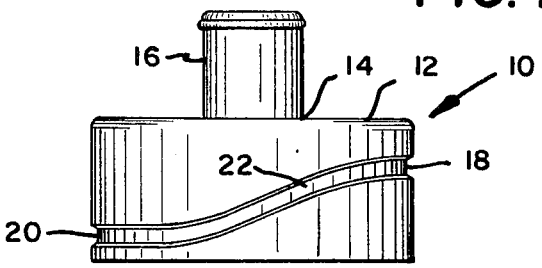
FIG. 4
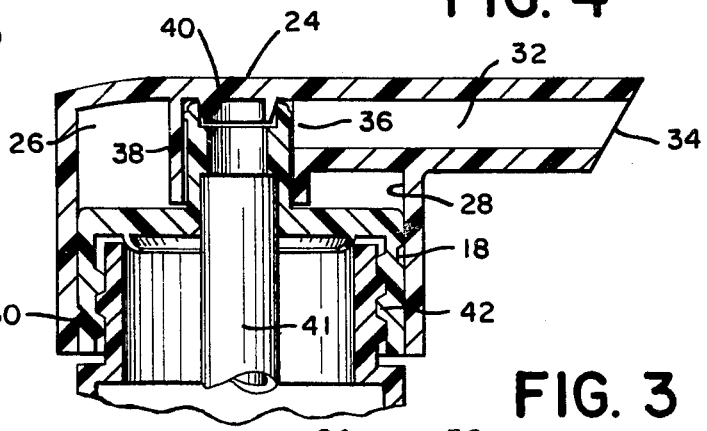
FIG. 3
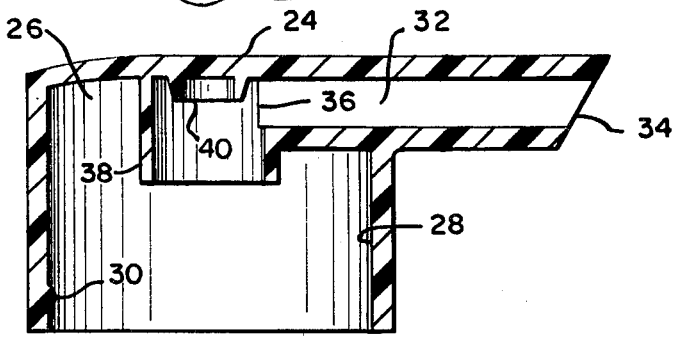
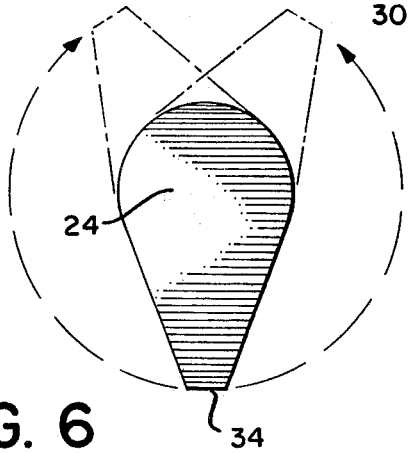
FIG. 6
FIG. 5
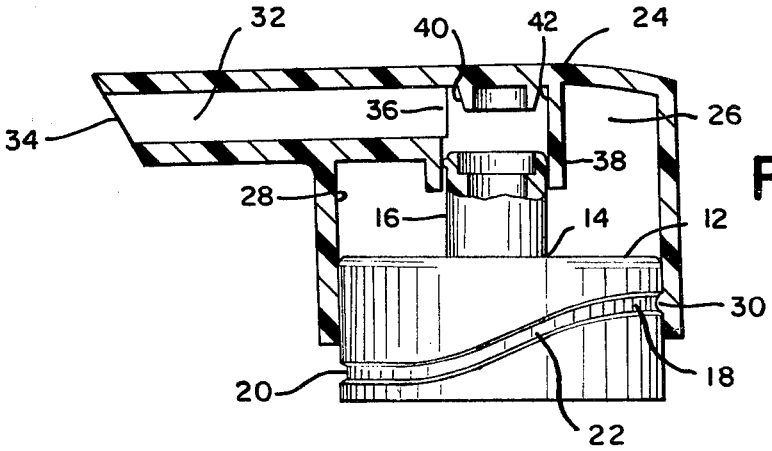

CAP AND NECK UNIT FOR FLUID DISPENSER

BACKGROUND OF THE INVENTION

Copending application Ser. No. 319,946 entitled Bellows Actuated Foam Dispenser was filed on the same day as the present application. The inventor applicant of the present invention is the same inventor applicant of the aforesaid application which is incorporated by reference herein.

The copending application describes a bellows actuated foam dispenser which employs a cap with a discharge conduit having a discharge orifice. When the cap is rotated so that the orifice points in a selected direction, the orifice is open. When the cap is rotated so that the orifice points in a different direction, the orifice is closed.

The present invention is directed to a cap and neck unit that can be secured to the bellows actuated foam dispenser or other types of dispensers to function in the manner described above.

SUMMARY OF THE INVENTION

In accordance with the principles of the invention, a cap and neck unit for a fluid dispenser includes a vertical neck adapted for use with a fluid container. The neck has interconnected upper and lower sections. The lower section defines a first hollow vertical cylinder having a first diameter. The first cylinder has a closed top end with a central circular opening having a second and smaller diameter. The upper section defines a second hollow vertical cylinder having said second diameter and open at its upper and lower ends. The lower end is coincident with said central opening. The outer surface of said first cylinder has a single continuous endless groove which has upper and lower horizontal regions interconnected by inclined regions.

The unit also includes a cap having a top and a vertical interior chamber extending downwardly from the top and terminating in a hollow cylindrical region open at bottom. The region has a third cylindrical diameter larger than said first diameter and disposed concentrically about said neck. The region also has an inwardly extending horizontal prong engaging said groove. The cap is rotatable about said neck between a first position at which said prong engages said lower horizontal region and the vertical separation between said top and said upper end is a minimum, and a second position at which said prong engages said upper horizontal region and said separation is a maximum. Sealing means is secured to said top and is disposed within said chamber. The means closes said upper end when the cap is in the first position and leaves said upper end open when the cap is in said second position.

An elongated hollow discharge conduit open at both ends can be secured to said top. The sealing means is coupled to one conduit end to close same when the cap is in the first position and to establish communication between said one conduit end and said upper end when said cap is in said second position. The other end of the conduit is disposed outside of said chamber and constitutes a discharge orifice.

Consequently, any type of fluid dispenser can employ this cap and neck unit whereby unless the cap is properly positioned, fluid cannot escape from the discharge orifice.

BRIEF DESCRIPTION OF THE DRAWINGS

FIG. 1 is a perspective exploded view of the invention.

FIG. 2 is a side view of one of the parts used in the invention.

FIG. 3 is a cross sectional side view of another part used in the invention.

FIG. 4 is a cross sectional view of the invention shown in closed position whereby fluid cannot be dispensed.

FIG. 5 is a view similar to FIG. 4 in which the invention is shown in open position whereby fluid can be dispensed.

FIG. 6 is a top view of the part of FIG. 3 showing various positions of rotation.

DETAILED DESCRIPTION OF PREFERRED EMBODIMENT

Referring now to FIGS. 1–6, a vertical neck adapted to be secured to or integral with an open container of fluid has a lower section 10 which defines a first hollow cylinder with a first diameter and a closed top end 12. End 12 has a centrally disposed circular opening 14 having a second and smaller diameter. The neck has an upper section 16 which defines a second hollow cylinder open at both ends. The diameter of the second cylinder is equal to the second diameter. The lower end of the second cylinder is secured to end 12 and is aligned with opening 14. The outer surface of section 10 carries an endless continuous groove having an upper horizontal region 18, a lower horizontal region 20 and inclined regions 22 interconnecting regions 18 and 20. A cap has a top 24 and a vertical interior chamber 26 extending downwardly from the top. Chamber 26 terminates in a hollow cylindrical region 28 having a third diameter which is larger than the first diameter. Region 28 is disposed concentrically around the neck and has a horizontal inwardly extending prong 30 which engages the groove.

The cap is rotatable in either direction about the neck and as the prong engages the groove the cap has a first position, then the prong engages region 20 at which the vertical separation between top 24 and the upper end of section 16 is a minimum, and a second position at which the prong engages region 18 and this separation is a minimum. The groove defines a cam surface and the prong is a cam follower riding in the groove. The rotation thus raises or lowers the cap and the action is independent of the direction of rotation.

The cap has a hollow straight horizontal discharge conduit 32 secured to top 24 and extending outward. The conduit has a remote open end 34 which is a discharge port and an opposite open end 36 which communicates with the interior of a hollow vertical cylinder 38. Cylinder 38 is secured at its upper end to the cap and extends downward. The diameter of cylinder 28 is somewhat larger than the diameter of section 16 and is substantially smaller than the diameter of section 10. A cylinder 38 is disposed concentrically about section 16.

Secured to the top and disposed within cylinder 16 is a sealing member 40 which takes the form of a flat horizontal circular disc. When the cap is in the first position as shown in FIG. 4, member 40 engages the top end of section 16 and seals same whereby nothing can flow out of section 16 into conduit 34 for discharge. When the cap is in the second position as shown in FIG. 5, fluids can flow out of the section 16, through cylinder 38 into opening 36 and the conduit 32 to be discharged via port 34.

Typically, a dip tube 41 can extend downwardly below section 16 through section 10 into a container having a threaded neck 42 which can be threadedly engaged by the interior of section 10.

A circular groove 42 surrounds disc 40. When disc 40 fits into section 16, the top periphery of section 16 fits into groove 42 as a seal.

What is claimed is:

1. A cap and neck unit for a fluid dispenser, said unit comprising:

a vertical neck adapted for use with a fluid container, said neck having interconnected upper and lower sections, the lower section defining a first hollow vertical cylinder having a first diameter, said first cylinder having a closed top end with a central circular opening having a second and smaller diameter, said upper section defining a second hollow vertical cylinder having said second diameter and open at its upper and lower ends, the lower end being coincident with said central opening, the outer surface of said first cylinder having a single continuous endless groove which has upper and lower horizontal regions interconnected by inclined regions;

a cap having a top and a vertical interior chamber extending downwardly from the top and terminating in a hollow cylindrical region open at bottom, said region having a third cylindrical diameter larger than said first diameter and disposed concentrically about said neck, said region having an inwardly extending horizontal prong engaging said groove, said cap being rotatable about said neck between a first position at which said prong engages said lower horizontal region and the vertical separation between said top and said upper end of the upper section is a minimum and a second position at which said prong engages said upper horizontal region and said separation is a maximum;

an elongated hollow discharge conduit open at both first and second ends and secured to said top, the second end of the conduit being disposed outside the chamber and constituting a discharge orifice, said first conduit end being horizontally spaced from and disposed above the upper end of the upper section; and sealing means secured to said top and disposed within said chamber, said sealing means including a third vertical hollow cylinder secured at its upper end to said top and open at its lower end, said third cylinder having a fourth diameter larger than said second diameter and smaller than said first diameter, said third cylinder being disposed concentrically about said second cylinder, and further including a sealing member secured to said top and disposed within the third cylinder, said first conduit end being connected to the third cylinder and communicating with the interior thereof, said means closing the upper end of the upper section and closing said first conduit end with said member being in sealing engagement with the upper end of the upper section when said cap is in the first position, said means leaving the upper end of the upper section open with said member being spaced above the upper end of the upper section to establish communication between said first conduit end and the upper end of the upper section when said cap is in the second position.

2. The dispenser of claim 1 wherein said conduit is disposed horizontally.

3. The dispenser of claim 2 wherein said conduit extends along a straight line.

* * * * *